US009134639B2

(12) United States Patent
Nakano et al.

(10) Patent No.: US 9,134,639 B2
(45) Date of Patent: Sep. 15, 2015

(54) MAGENTA TONER

(75) Inventors: Masao Nakano, Kamakura (JP); Taichi Shintou, Saitama (JP); Yutaka Tani, Yokohama (JP); Takayuki Ujifusa, Ashigarakami-gun (JP); Kaoru Takahashi, Saitama (JP); Satoshi Saito, Mishima (JP); Takeshi Miyazaki, Ebina (JP); Masashi Hirose, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/131,427

(22) PCT Filed: Jul. 24, 2012

(86) PCT No.: PCT/JP2012/069274

§ 371 (c)(1),
(2), (4) Date: Jan. 7, 2014

(87) PCT Pub. No.: WO2013/015435

PCT Pub. Date: Jan. 31, 2013

(65) Prior Publication Data

US 2014/0162182 A1 Jun. 12, 2014

(30) Foreign Application Priority Data

Jul. 27, 2011 (JP) ..... 2011-163862

(51) Int. Cl.
*G03G 9/00* (2006.01)
*G03G 9/09* (2006.01)

(52) U.S. Cl.
CPC ..... *G03G 9/09* (2013.01)

(58) Field of Classification Search
CPC ..... G03G 9/09; G03G 9/0906
USPC ..... 430/108.1, 123.57, 137.1, 137.15
See application file for complete search history.

(56) References Cited

U.S. PATENT DOCUMENTS

| | | | |
|---|---|---|---|
| 5,187,282 A | 2/1993 | Carlier et al. | |
| 2011/0189096 A1 * | 8/2011 | Watanabe et al. | 424/9.1 |
| 2014/0113229 A1 | 4/2014 | Tani et al. | |

FOREIGN PATENT DOCUMENTS

| | | |
|---|---|---|
| EP | 1 626 071 A1 | 2/2006 |
| JP | 46-832 A | 1/1971 |
| JP | 47-37496 A | 9/1972 |
| JP | 49-30419 A | 3/1974 |
| JP | 5-117536 A | 5/1993 |
| JP | 9-255882 A | 9/1997 |
| JP | 2006-243064 A | 9/2006 |
| JP | 2009-229497 A | 10/2009 |
| JP | 2010-148447 A | 7/2010 |

OTHER PUBLICATIONS

PCT International Search Report and Written Opinion of the International Searching Authority, International Application No. PCT/JP2012/069274, Mailing Date Oct. 9, 2012.

* cited by examiner

*Primary Examiner* — Thorl Chea
(74) *Attorney, Agent, or Firm* — Fitzpatrick, Cella, Harper and Scinto

(57) ABSTRACT

An object of the present invention is to provide a magenta toner having high lightness and saturation and having spectral reflection properties having a wider color range.

A magenta toner including magenta toner particles each including a binder resin and a colorant, wherein the colorant includes a compound represented by a formula (1):

Formula (1)

(wherein $R_1$ and $R_2$ represent an alkyl group or an alkoxyalkyl group, and at least one of $R_1$ and $R_2$ has not less than 7 carbon atoms).

9 Claims, 1 Drawing Sheet

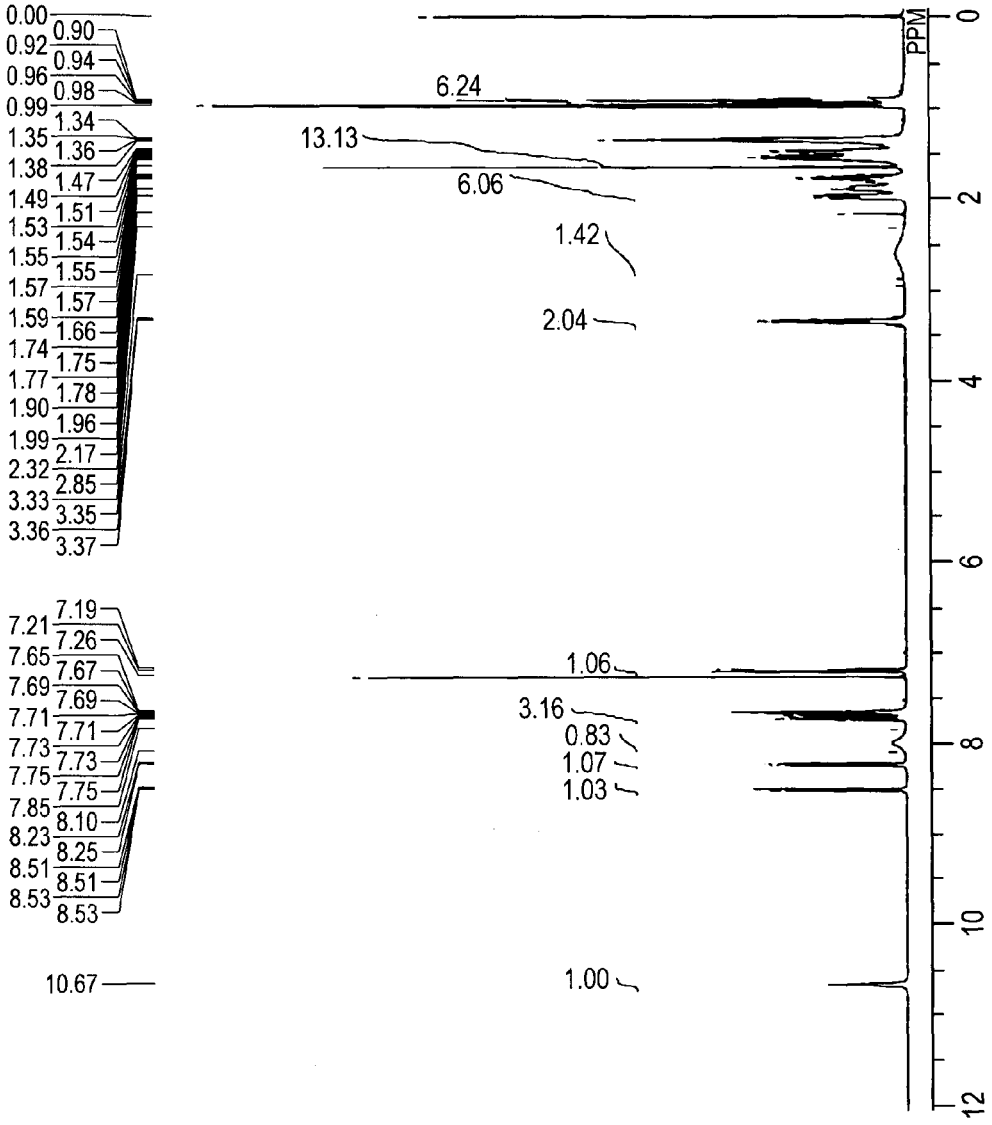
0.00
0.92
0.96
0.99
1.35
1.38
1.49
1.53
1.55
1.57
1.59
1.74
1.77
1.90
1.99
2.32
3.33
3.36
0.90
0.94
0.98
1.34
1.36
1.47
1.51
1.54
1.55
1.57
1.66
1.75
1.78
1.96
2.17
2.85
3.35
3.37
7.21
7.65
7.69
7.71
7.73
7.75
7.85
8.23
8.51
8.53
7.19
7.26
7.67
7.69
7.71
7.73
7.75
8.10
8.25
8.51
8.53
10.67
6.24
13.13
6.06
1.42
2.04
1.06
3.16
0.83
1.07
1.03
1.00
PPM
0
2
4
6
8
10
12

MAGENTA TONER

TECHNICAL FIELD

The present invention relates to a magenta toner used in recording methods such as electrophotography, electrostatic recording, magnetic recording, a toner jet method, and liquid development, and a method for producing the magenta toner.

BACKGROUND ART

Recently, color images are widely spread, and higher image quality has been increasingly demanded. In digital full color copiers and printers, a color image manuscript is subjected to color separation with filters of blue, green, and red, and latent images corresponding to the original image are developed with developers of magenta, magenta, cyan, and black. For this reason, the colorants in the developers of the respective colors give a great influence to image quality. Usually, in the case where a pigment is dispersed in a variety of media, it is difficult to form a sufficiently fine pigment or to uniformly disperse the pigment.

In the color toners, the magenta toner is important in reproduction of a skin color. Further, the color tone of the skin in a human figure is a halftone. Accordingly, high developing properties are also demanded. As a colorant for a magenta toner, quinacridone colorants, thioindigo colorants, xanthene colorants, monoazo colorants, perylene colorants, and diketopyrrole colorants are known.

In the case where a dye is used in the colorant for magenta, the dye demonstrates a vivid magenta color in the initial period. The dye, however, has low lightfastness, and color nuance greatly changed after the dye is left. Moreover, in the case of a light color, a bright and sharp image is obtained. In a region of a dark color, however, a sufficient image density is difficult to obtain. Particularly, in the case where the colors are mixed and a dark red color and a dark blue color are reproduced, the range of the color to be reproduced is likely to be narrower. The xanthene colorant is a colorant having good color reproducibility and color tone, but the lightfastness is significantly reduced when the colorant is used in a liquid form. Accordingly, various measures are needed (see Patent Literatures 1 and 2). These magenta colorants have good affinity with a binder resin and high lightfastness, and provide a magenta toner having high frictional charging properties and an excellent color tone. In order to satisfy transparency and provide an image closer to the manuscript, however, a magenta toner having further improved color tone, saturation, and electrophotographic properties is strongly desired.

CITATION LIST

Patent Literature

PTL 1: Japanese Patent Application Laid-Open No. H09-255882

PTL 2: Japanese Patent Application Laid-Open No. H05-117536

SUMMARY OF INVENTION

Technical Problem

An object of the present invention is to solve the problems above. Namely, an object of the present invention is to provide a magenta toner that has high lightness and saturation, and can provide an image closer to the manuscript.

Solution to Problem

The objects are achieved by the invention below.

Namely, the present invention relates to a magenta toner including magenta toner particles each including a binder resin and a colorant, wherein the colorant includes a compound represented by a formula (1):

Formula (1)

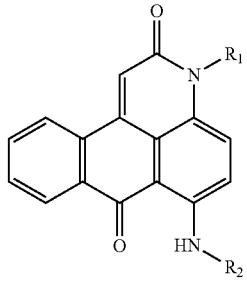

(wherein $R_1$ and $R_2$ represent an alkyl group or an alkoxyalkyl group, and at least one of $R_1$ and $R_2$ has not less than 7 carbon atoms.)

Advantageous Effects of Invention

The present invention can provide a magenta toner having high lightness and saturation and having spectral reflection properties having a wider color range.

BRIEF DESCRIPTION OF DRAWINGS

FIG. 1 is a drawing illustrating $^1$H NMR spectrum of a compound (2) represented by the formula (1) in $CDCl_3$ at room temperature and 400 MHz according to the present invention.

DESCRIPTION OF EMBODIMENTS

Hereinafter, the present invention will be described more in detail using embodiments.

As a result of extensive research in order to solve the problems in the related art, the present inventors found out that a magenta toner having high lightness and saturation and having spectral reflection properties having a wider color range is obtained.

A magenta toner according to the present invention is a magenta toner including magenta toner particles each including a binder resin and a colorant, wherein the colorant includes a compound represented by a formula (1).

<Colorant>

The colorant used in the present invention is a compound represented by the formula (1):

Formula (1)

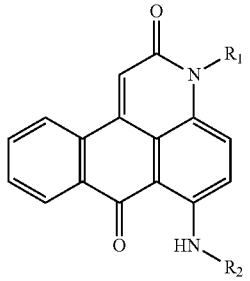

(wherein $R_1$ and $R_2$ represent an alkyl group or an alkoxyalkyl group, and at least one of $R_1$ and $R_2$ has not less than 7 carbon atoms.)

The alkyl group of $R_1$ and $R_2$ in the formula (1) is not particularly limited, and examples thereof include a linear, branched, or cyclic alkyl group having 1 to 20 carbon atoms such as methyl, ethyl, propyl, butyl, octyl, dodecyl, nonadecyl, cyclobutyl, cyclopentyl, cyclohexyl, methylcyclohexyl, or ethylhexyl. As the alkyl group having not less than 7 carbon atoms, preferred is a branched alkyl group such as a 2-ethylhexyl group because of the high solubility thereof in a solvent. Particularly preferred is a branched alkyl group having not less than 8 carbon atoms.

The alkoxyalkyl group of $R_1$ and $R_2$ in the formula (1) is not particularly limited, and examples thereof include a 3-butoxypropyl group and a 3-(2-ethylhexyloxy)propyl group. These are highly soluble in a solvent and particularly preferred.

Further, $R_1$ and $R_2$ may have a substituent which does not significantly inhibit the stability of the compound. The substituent is not particularly limited, and examples thereof include aryl groups such as a phenyl group; monosubstituted amino groups such as a methylamino group and a propylamino group; and disubstituted amino groups such as a dimethylamino group, a dipropylamino group, or an N-ethyl-N-phenyl group.

The compound represented by formula (1) according to the present invention can be synthesized by a known method. One embodiment of a method for producing the compound represented by formula (1) according to the present invention will be shown, but the production method will not be limited to this.

Namely, Compound B can be obtained by acetylating Compound A with acetic anhydride. Further, Compound B is cyclized to obtain Compound C. Compound C and an amine compound are condensed to obtain a compound represented by the formula (1) according to the present invention. Persons skilled in the art can properly select addition of a reaction such as known protection and deprotection reactions and hydrolysis in the functional groups of the respective compounds when necessary.

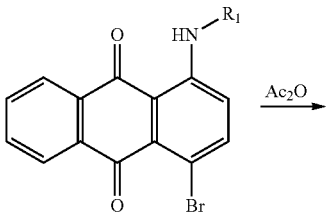

Compound A

-continued

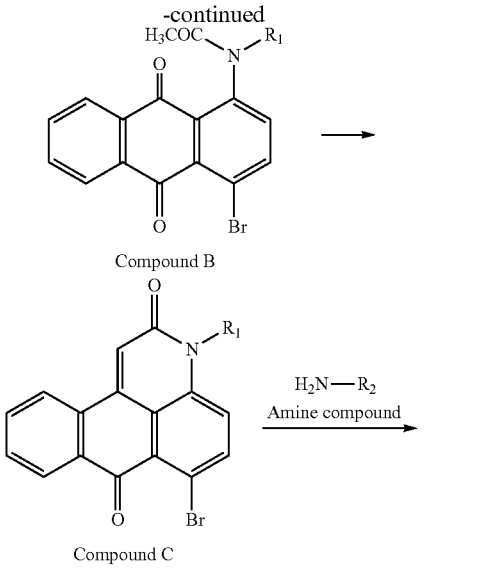

Compound B

Compound C

Formula (1)

In the present invention, the compound represented by the formula (1) can be used alone, or two or more thereof can be used in combination. Alternatively, the compound can be used in combination with two or more known magenta pigments and dyes.

<Binder Resin>

Examples of the binder resin used in the present invention can include thermoplastic resins.

Specifically, examples thereof include homopolymers or copolymers of styrenes such as styrene, para-chlorostyrene, and α-methylstyrene (styrene resins); homopolymers or copolymers of esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate (vinyl resins); homopolymers or copolymers of vinylnitriles such as acrylonitrile and methacrylonitrile (vinyl resins); homopolymers or copolymers of vinyl ethers such as vinyl ethyl ether and vinyl isobutyl ether thereof (vinyl resins); homopolymers or copolymers of ketones such as vinyl methyl ketone, vinyl ethyl ketone, and vinyl isopropenyl ketone (vinyl resins); homopolymers or copolymers of olefins such as ethylene, propylene, butadiene, and isoprene (olefin resins); non-vinyl condensation resins such as epoxy resins, polyester resins, polyurethane resins, polyamide resins, cellulose resins, and polyether resins; and graft polymers of these non-vinyl condensation resins and vinyl monomers. These resins may be used alone, or two or more thereof may be used in combination. A preferred binder resin is resins having a glass transition temperature (Tg) of 40 to 75° C. At a glass transition temperature within the range above, the toner has high storage stability and durable stability, and a highly transparent image is likely to be obtained.

The polyester resins are synthesized from an acid (dicarboxylic acid) component and an alcohol (diol) component. Examples of the acid component and those of the alcohol components include compounds below, respectively.

As the acid component, preferable are aliphatic dicarboxylic acids, and particularly preferable are linear carboxylic acids. Examples thereof include, but not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, or lower alkyl esters thereof and acid anhydrides thereof.

Preferably, other than the aliphatic dicarboxylic acids, the acid component includes a dicarboxylic acid having a double bond, and a dicarboxylic acid having a sulfonate group.

A preferred alcohol component is aliphatic diols. Examples thereof include, but not limited to, ethylene glycol, 1,3-propanediol, 1,4-butanediol, 1,5 pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol.

<Wax>

The magenta toner according to the present invention preferably contains wax. The wax means a material used to prevent offset when the toner is fixed. Specifically, the followings are often used: hydrocarbon waxes such as low molecular weight polyethylenes, low molecular weight polypropylenes, microcrystalline waxes, and paraffin waxes; oxides of hydrocarbon waxes such as oxidized polyethylene wax or block copolymers thereof; fatty acid ester waxes such as carnauba wax, Sasol wax, and montanic acid ester wax; fatty acid esters partially or totally deoxidated such as deacidified carnauba wax; saturated linear fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; fatty acid amides such as linoleic acid amide, oleic acid amide, lauric acid amide; saturated fatty acid bisamides such as methylene bis(stearic acid amide), ethylene bis(capric acid amide), ethylene bis(lauric acid amide), and hexamethylene bis(stearic acid amide); unsaturated fatty acid amides such as ethylene bis(oleic acid amide), hexamethylene bis(oleic acid amide), N,N'-dioleyladipic acid amide, and N,N'-dioleylsebacic acid amide; aromatic bisamides such as m-xylene bis (stearic acid amide) and N,N'-distearyl isophthalic acid amide; aliphatic metal salts such as calcium stearate, calcium laurate, zinc stearate, and magnesium stearate (usually, called metallic soap); grafted waxes obtained by grafting aliphatic hydrocarbon waxes with a vinyl monomer such as styrene and acrylic acid; partially esterified products of fatty acids and polyhydric alcohols such as behenic acid monoglyceride; methyl ester compounds having a hydroxyl group obtained by hydrogenating vegetable oils and fats; and long-chain alkyl alcohols or long-chain alkyl carboxylic acids having not less than 12 carbon atoms. Among these, preferred examples thereof include hydrocarbon waxes, fatty acid ester waxes, and saturated alcohols from the viewpoint of the releasing properties and dispersibility in the resin. Alternatively, these waxes may be used alone, or when necessary, two or more thereof may be used in combination.

The content of these waxes contained in the toner is preferably 1 to 25 parts by mass, and more preferably 3 to 20 parts by mass based on 100 parts by mass of the toner particle. At a content of the wax component less than 1 part by mass, the releasing effect as the wax is reduced. At a content of the wax component more than 25 parts by mass, while the releasing properties are satisfied, the developing properties are reduced. As a result, a problem tends to occur such that the toner is fused on the developing sleeve or the surface of the electrostatic latent image bearing member.

These waxes have a melting point of preferably not less than 50° C. and not more than 200° C., and more preferably not less than 50° C. and not more than 150° C. If the wax has a melting point less than 50° C., blocking resistance of the toner may be reduced. If the wax has a melting point more than 200° C., exudation properties of the wax during fixing may be reduced, reducing the releasing properties in oilless fixing.

In the present invention, the melting point designates a main endothermic peak temperature in a differential scanning calorimetric (DSC) curve measured according to ASTM D3418-82. Specifically, the melting point of the wax is a main endothermic peak temperature in the DSC curve obtained as follows: using a differential scanning calorimeter (made by Mettler Toledo International Inc.: DSC822), the DSC curve in the temperature range of 30 to 200° C. is obtained in the second temperature raising process under a normal temperature and normal humidity environment, wherein the range of the measurement temperature is 30 to 200° C., and the temperature raising rate is 5° C./min.

<Charge Control Agent>

The toner according to the present invention preferably contains a charge control agent in the toner particle. A known charge control agent can be used. Particularly preferred is a charge control agent having a high charging speed and capable of stably keeping a constant charging amount. Further, in the case where the toner is produced directly by the polymerization, particularly preferred is a charge control agent having low polymerization inhibiting properties and containing substantially no soluble substance in the water-based dispersion medium.

Examples of the charge control agent that controls and gives the toner a negative charge property include polymers or copolymers having a sulfonate group, a sulfonic acid salt group or a sulfonic acid ester group; salicylic acid derivatives and metal complexes; monoazo metal compounds; acetylacetone metal compounds; aromatic oxycarboxylic acids, aromatic mono- and polycarboxylic acids, metal salts thereof, anhydrides thereof, esters thereof; phenol derivatives such as bisphenols thereof; urea derivatives; metal-containing naphthoic acid compounds; boron compounds; quaternary ammonium salts; calixarenes; and resin charge control agents.

Examples of the charge control agent that controls and gives the toner a positive charge property include, nigrosine and nigrosine modified products with fatty acid metallic salts; guanidine compounds; imidazole compounds; quaternary ammonium salts such as tributylbenzylammonium-1-hydroxy-4-naphthosulfonic acid salts and tetrabutylammonium tetrafluoroborate, onium salts such as phosphonium salts that are analogs thereof, and lake pigments thereof; triphenylmethane dyes and lake pigments thereof (examples of a laking agent include phosphorus tungstate, phosphorus molybdate, phosphorus tungsten molybdate, tannic acid, lauric acid, gallic acid, ferricyan compounds, and ferrocyan compounds); metal salts of higher fatty acids; diorganotin oxides such as dibutyltin oxide, dioctyltin oxide, dicyclohexyltin oxide; diorganotin borates such as dibutyltin borate, dioctyltin borate, and dicyclohexyltin borate; and resin charge control agents. These can be used alone, or two or more thereof can be used in combination.

A shear force may be applied to a dry inorganic particle of silica, alumina, titania, or calcium carbonate or a dry resin particle of a vinyl resin, a polyester resin, or a silicone resin, and the particle may be added to the surface of the toner particle. These inorganic particles and resin particles function as an external additive such as a fluidity aide or a cleaning aide.

The magenta toner according to the present invention has a weight average particle size D4 of 4.0 to 9.0 μm. The ratio of the weight average particle size D4 to the number average particle size D1 (hereinafter, also referred to as weight average particle size D4/number average particle size D1 or D4/D1) is preferably not more than 1.35. Further, the weight average particle size D4 is 4.9 to 7.5 μm, and the weight average particle size D4/number average particle size D1 is more preferably not more than 1.30. In the value of the weight average particle size D4, if the proportion of the particle size less than 4.0 μm is increased, it is difficult to attain charging stability when the toner is used in an electrophotographic developing system. For this reason, degradation of an image such as image fogging and developing stripes is likely to occur in an operation in which a large amount of sheets is continuously developed (durable operation). This tendency is remarkable particularly in the case where fine powder of not more than 2.5 μm is increased. If the proportion of the toner particle having a weight average particle size D4 more than 8.0 μm is increased, reproductivity of a halftone portion is significantly reduced. As a result, the obtained image is a rough image, and not preferable. The tendency is remarkable particularly when coarse powder of not less than 10.0 μm is increased. If the weight average particle size D4/number average particle size D1 is more than 1.35, fogging and transfer properties are reduced, and the line width of a thin line greatly fluctuates (hereinafter, referred to as reduction in sharpness).

In the magenta toner according to the present invention, the weight average particle size D4 and the number average particle size D1 are adjusted by a method depending on the method for producing a toner particle. For example, in the case of the suspension polymerization method, D4 and D1 can be adjusted by controlling the concentration of the dispersant used in preparation of the water-based dispersion medium, the reaction stirring rate, or the reaction stirring time.

In the magenta toner according to the present invention, preferably, the average circularity of the magenta toner measured by a flow type particle image analyzer is 0.950 to 0.995, and more preferably 0.960 to 0.990 because the transfer properties of the toner are significantly improved.

The toner according to the present invention may be any of a magnetic toner and a non-magnetic toner. In use as the magnetic toner, a magnetic material may be mixed with the toner particle that forms the toner according to the present invention, and used. Examples of such a magnetic material include iron oxides such as magnetite, maghemite, and ferrite; or iron oxides containing other metal oxide; and metals such as Fe, Co, and Ni, alloys of these metals and a metal such as Al, Co, Cu, Pb, Mg, Ni, Sn, Zn, Sb, Be, Bi, Cd, Ca, Mn, Se, Ti, W, and V, and a mixture thereof.

Examples of the method for producing the toner particle include a crushing method, a suspension polymerization method, a suspension granulation method, an emulsion polymerization method, and an emulsion agglutination method which are conventionally used. From the viewpoint of environmental load during production and controllability of the particle size, among these production methods, particularly preferred are the suspension polymerization method, the suspension granulation method, a production method in which granulation is performed in a water-based medium, and emulsion agglutination method. The toner according to the present invention can be used for a developer used in liquid development (hereinafter, referred to as a liquid developer).

<Production of Toner According to Emulsion Agglutination Method>

Hereinafter, as a production method according to the present invention, a method for producing a toner particle according to an emulsion agglutination method will be described in which a mixture containing a colorant and an emulsifier is emulsified in a water-based medium.

First, a resin particle is dispersed to prepare a resin particle dispersion liquid, a colorant particle is dispersed to prepare a colorant particle dispersion liquid, and a wax particle is dispersed to prepare a wax particle dispersion liquid. Then, a mixed solution of these is prepared. At this time, when necessary, other toner component may be mixed. The toner particle is obtained by a step of agglutinating the resin particle, colorant particle, and, wax particle at least contained in the prepared mixed solution to form an agglutinated particle (agglutination step), a step of heating and fusing the agglutinated particle (fusing step), a washing step, and a drying step.

<Aggregation Step>

A method for forming an aggregate particle is not particularly limited. Suitably included is a method in which a pH adjuster, a flocculant, a stabilizer, and the like are added to and mixed with the mixed solution, and a temperature is properly raised, or a mechanical force (stirring) is properly applied.

The pH adjuster is not particularly limited, and examples thereof include alkalis such as ammonia and sodium hydroxide and acids such as nitric acid and citric acid. Examples of the flocculant include surfactants having a polarity opposite to that of the surfactant used to disperse the particle; inorganic metal salts such as sodium chloride, magnesium carbonate, magnesium chloride, magnesium nitrate, magnesium sulfate, calcium chloride, and aluminum sulfate; and metal complexes having a valence of 2 or more.

Examples of the stabilizer mainly include the surfactants or a water-based medium containing these.

The surfactant is not particularly limited, and examples thereof include water-soluble polymers such as polyvinyl alcohol, methyl cellulose, carboxymethyl cellulose, and sodium polyacrylate; surfactants, i.e., anionic surfactants such as sodium dodecylbenzenesulfonate, octadecyl sodium sulfate, sodium oleate, sodium laurylate, and potassium stearate; cationic surfactants such as laurylamine acetate and lauryltrimethylammonium chloride; amphoteric surfactants such as lauryldimethylamine oxide; and nonionic surfactants such as polyoxyethylene alkyl ether, polyoxyethylene alkylphenyl ether, and polyoxyethylenealkylamine; and inorganic compounds such as tricalcium phosphate, aluminum hydroxide, calcium sulfate, calcium carbonate, and barium carbonate. These may be used alone, or when necessary, two or more thereof may be used in combination.

The average particle size of the agglutinated particle formed here is not particularly limited. Usually, the average particle size of the agglutinated particle may be controlled to have substantially the same average particle size as that of the toner particle to be obtained. The control can be easily performed, for example, by properly setting and changing the temperature in addition and mixing of the flocculant and the like and the stirring mixing condition. In order to prevent fusing between the toner particles, the pH adjuster, the surfactant, and the like can be properly used.

<Fusing Step>

In the fusing step, the aggregate particle is heated to be fused. Thus, a toner particle is formed. The heating temperature may be a temperature between the glass transition temperature (Tg) of the resin contained in the aggregate particle and the decomposition temperature of the resin. For example, under stirring similar to that in the aggregation step, progression of the aggregation is stopped by addition of the surfactant or adjustment of the pH, and the resin contained in the resin particle is heated to a temperature not less than the glass transition temperature thereof. Thereby, the aggregate particle is fused and coalesced. The heating time may be a time during which the aggregate particle is sufficiently fused. Specifically, the heating may be performed approximately for 10 minutes to 10 hours.

The method can further include a step of adding and mixing a fine particle dispersion liquid having fine particles dispersed therein and applying the fine particle to the agglutinated particle to form a core shell structure (applying step) before or after the fusing step.

<Washing Step>

In the present invention, the toner particle obtained in the fusing step is washed, filtered, and dried on a proper condition to obtain a toner particle. In this case, in order to ensure sufficient charging properties and reliability as the toner, preferably, the toner particle is sufficiently washed.

The washing method is not limited. For example, a suspension containing toner particle is filtered. The filtrate is stir washed with distilled water, and this solution is further filtered. From the viewpoint of charging properties of the toner, the washing is repeated until the electric conductivity of the filtrate reaches 150 μS/cm or less. At an electric conductivity more than 150 μS/cm, the charging properties of the toner are reduced, resulting in defects such as fogging and reduction in the image density.

<Drying Step>

Drying can be performed using a known standard method such as a vibrating fluidizing dry method, a spray dry method, a freeze dry method, and a flash jet method. The proportion of water contained in the toner particle after drying is preferably not more than 1.5% by mass, and more preferably not more than 1.0% by mass.

The toner obtained by the method for producing a toner according to the present invention, in which the particle size of the pigment particle is small and the surfactant in the toner is easy to remove, has remarkable effects such as high image density and suppression of fogging.

The resin particle dispersion liquid used in the present invention is prepared by dispersing a resin particle in a water-based medium.

In the present invention, the water-based medium means a medium containing water as a main component. Specific examples of the water-based medium include water itself, water to which a pH adjuster is added, and water to which an organic solvent is added.

The resin that forms the resin particle contained in the resin particle dispersion liquid is not particularly limited as long as it is a resin suitable for the toner having the following properties. Preferable are thermoplastic binder resins having a glass transition temperature not more than the fixing temperature in an electrophotographic apparatus.

Specific examples thereof can include styrenes such as styrene, para-chlorostyrene, and α-methylstyrene; vinyl monomers such as methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate, 2-ethylhexyl methacrylate, acrylonitrile, and methacrylonitrile; vinyl ether monomers such as vinyl methyl ether and vinyl isobutyl ether; vinyl ketone monomers such as vinyl methyl ketone, vinyl ethyl ketone, and vinyl isopropenyl ketone; homopolymers of polyolefin monomers such as ethylene, propylene, and butadiene, copolymers in combination with two or more thereof, or a mixture of the homopolymer and the copolymer; epoxy resins, polyester resin, polyurethane resins, polyamide resins, cellulose resins, polyether resins, and non-vinyl condensation resins, or a mixture thereof with the vinyl resins; or graft polymers obtained by polymerizing a vinyl monomer in the presence of these. Particularly from the viewpoint of the fixing properties and charging ability as the toner, polystyrene resins or polyester resins are particularly preferably used. These resins may be used alone, or two or more thereof may be used in combination.

The resin particle dispersion liquid used in the present invention is prepared by dispersing a resin particle in a water-based medium. The resin particle dispersion liquid is prepared by a known method. For example, in the case of the resin particle dispersion liquid containing a resin particle including a vinyl monomer, particularly a styrene monomer, as a constituent element, the resin particle dispersion liquid can be prepared by emulsion polymerizing the monomer with an surfactant or the like.

In the case of the resin produced by other method (for example, a polyester resin), the resin is dispersed with an ionic surfactant and a polymer electrolyte in water using a dispersing machine such as a homogenizer. Subsequently, the solvent is vaporized. Thereby, the resin particle dispersion liquid can be prepared. Alternatively, the resin particle dispersion liquid may be prepared by a method in which a surfactant is added to a resin, and the mixture is emulsion dispersed in water by a dispersing machine such as homogenizer, or a phase inversion emulsion method.

The median particle size based on the volume of the resin particle contained in the resin particle dispersion liquid is preferably 0.005 to 1.0 μm, and more preferably 0.01 to 0.4 μm. At a median particle size not less than 1.0 μm, it is difficult to obtain a toner particle having a suitable weight average particle size of 3.0 to 7.5 μm as the toner particle.

In the colorant particle dispersion liquid according to the present invention, a colorant particle dispersion liquid is obtained using the compound represented by the formula (1) as the colorant. The colorant particle dispersion liquid is prepared by dispersing a colorant particle together with a surfactant in a water-based medium. The colorant particle is dispersed by a known method. For example, a media dispersing machine such as a rotary shear type homogenizer, a ball mill, a sand mill, and an Attritor, or a high pressure counter collision dispersing machine is preferably used.

The amount of the surfactant to be used is 0.01 to 10 parts by mass, preferably 0.1 to 5.0 parts by mass based on 100 parts by mass of the colorant. Particularly, the amount is preferably 0.5 parts by mass to 3.0 parts by mass based on 100 parts by mass of the colorant because the surfactant in the toner particle is easy to remove. As a result, the amount of the surfactant remaining in the obtained toner is reduced, providing effects such as high image density of the toner and suppression of fogging.

In production of the resin particle dispersion liquid, a resin and the compound represented by the formula (1) may be prepared in advance at the same time, and dispersed in a water-based medium and used.

The wax dispersion liquid is prepared by dispersing a wax in a water-based medium. The wax dispersion liquid is prepared by a known method.

The average particle size of the resin particle can be measured, for example, using a dynamic light scattering (DLS) method, a laser light scattering method, centrifugation, a field-flow fractionation method, or an electrical sensing zone method. The average particle size in the present invention means a 50% cumulative particle size value based on the volume (D50) measured at 20° C. and the concentration of the solid content of 0.01% by mass by a dynamic light scattering (DLS)/laser doppler method, as described later, unless otherwise specified.

Examples of the surfactant include water-soluble polymers, inorganic compounds, and ionic or nonionic surfactants. Particularly from the viewpoint of the dispersibility, preferable are ionic surfactants having high dispersibility, and particularly preferable are use of anionic surfactants.

From the viewpoint of washability, the upper limit of the molecular weight of the surfactant is preferably 10,000, and more preferably 5,000. Meanwhile, from the viewpoint of the surface activity, the lower limit of the molecular weight is preferably 100, and more preferably 200.

Specific examples of the surfactant include water-soluble polymers such as polyvinyl alcohol, methyl cellulose, carboxymethyl cellulose, and sodium polyacrylate; surfactants, i.e., anionic surfactants such as sodium dodecylbenzenesulfonate, octadecyl sodium sulfate, sodium oleate, sodium laurate, and potassium stearate; cationic surfactants such as laurylamine acetate and lauryltrimethylammonium chloride; amphoteric surfactants such as lauryldimethylamine oxide; and nonionic surfactants such as polyoxyethylene alkyl ether, polyoxyethylene alkylphenyl ether, and polyoxyethylenealkylamine; and inorganic compounds such as tricalcium phosphate, aluminum hydroxide, calcium sulfate, calcium carbonate, and barium carbonate. Note that these can be used alone, or when necessary, two or more thereof can be used in combination.

<Method for Producing Toner by Suspension Polymerization Method>

Hereinafter, a method for producing a polymerized toner particle by a suspension polymerization method will be described.

In production of a toner particle by the suspension polymerization method, preferably, first, a colorant dispersion (masterbatch) is prepared in which the compound represented by the formula (1) is dispersed or dissolved in a medium in a high concentration. If the colorant dispersion is prepared in advance, the dispersibility of the colorant in the toner particle can be enhanced, and a toner particle having high lightness and saturation and spectral reflection properties having a wider color range can be obtained.

The colorant dispersion is obtained by dispersing the colorant represented by the formula (1) in an organic solvent. The dispersing machine used at this time is not particularly limited. For example, a media dispersing machine such as a rotary shear type homogenizer, a ball mill, a sand mill, and an Attritor, or a high pressure counter collision dispersing machine is preferably used. As the organic solvent, a polymerizable monomer is preferably used. The polymerizable monomer will be described later.

The colorant dispersion, the polymerizable monomer, the wax component, and the polymerization initiator are mixed to prepare a polymerizable monomer composition. Next, the polymerizable monomer composition is dispersed in a water-based medium, and the particle of the polymerizable monomer composition is granulated. Then, the polymerizable monomer in the particle of the polymerizable monomer composition is polymerized in the water-based medium to obtain a toner particle.

The polymerizable monomer is an addition polymerizable or condensation polymerizable monomer, and preferably an addition polymerizable monomer. Specifically, examples thereof can include styrene monomers such as styrene, o-methylstyrene, m-methylstyrene, p-methylstyrene, o-ethylstyrene, m-ethylstyrene, and p-ethylstyrene; acrylate monomers such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile, and acrylic acid amide; methacrylate monomers such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile, methacrylic acid amide; olefin monomers such as ethylene, propylene, butylene, butadiene, isoprene, isobutylene, and cyclohexene; halogenated vinyls such as vinyl chloride, vinylidene chloride, vinyl bromide, and vinyl iodide; vinyl esters such as vinyl acetate, vinyl propionate, and vinyl benzoate; vinyl ethers such as vinyl methyl ether, vinyl ethyl ether, vinyl isobutyl ether; and vinyl ketone compounds such as vinyl methyl ketone, vinyl hexyl ketone, and methyl isopropenyl ketone. Depending on applications, these can be used alone, or two or more thereof can be used in combination. In the case where the ink composition according to the present invention is used in an application of a polymerized toner, among the polymerizable monomers, styrene or a styrene monomer is preferably used alone, or mixed with other polymerizable monomer and used. Particularly preferred is styrene because of easiness in handling.

Further, a resin may be added to the polymerizable monomer composition. The resin which can be used depends on the purpose and application, and is not particularly limited. Specifically, examples of the resin include polystyrene resins, styrene copolymers, polyacrylic acid resins, polymethacrylic acid resins, polyacrylic acid ester resins, polymethacrylic acid ester resins, acrylic acid copolymers, methacrylic acid copolymers, polyester resins, polyvinyl ether resins, polyvinyl methyl ether resins, polyvinyl alcohol resins, and polyvinyl butyral resins. These resins can be used alone, or two or more thereof can be used in combination.

In the case where the toner is produced directly by the suspension polymerization method or the like, a polar resin is added during the polymerization reaction from the dispersing step to the polymerizing step. Thereby, depending on the balance between the polymerizable monomer composition as a toner base particle and the polarity of the water-based dispersion medium, control can be performed such that the added polar resin forms a thin layer on the surface of the toner base particle, or exists graded from the surface of the toner base particle toward the center thereof. At this time, if a polar resin having an interaction with the colorant or the charge control agent is used, a preferred state of the colorant existing in the toner can be provided.

Moreover, in order to enhance mechanical strength of the toner particle and control the molecular weight of the toner molecule, a crosslinking agent can also be used during synthesis of the binder resin.

The crosslinking agent is not particularly limited, and examples of bifunctional crosslinking agents include divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycols #200, #400, and #600, dipropylene glycol diacrylate, polypropylene glycol diacrylate, polyester diacrylate, and those in which diacrylate is replaced by dimethacrylate.

The polyfunctional crosslinking agent is not particularly limited, and examples thereof include pentaerythritol triacrylate, trimethylolethane triacrylate, trimethylolpropane triacrylate, tetramethylolmethane tetraacrylate, oligoester acrylate and methacrylate thereof, 2,2-bis(4-methacryloxyphenyl)propane, diallyl phthalate, triallyl cyanurate, triallyl isocyanurate, and triallyl trimellitate.

The amount of these crosslinking agents to be used is preferably 0.05 to 10 parts by mass, and more preferably 0.1 to 5 parts by mass based on 100 parts by mass of the monomer.

Examples of a polymerization initiator used in the suspension polymerization method can include known polymerization initiators, and include azo compounds, organic peroxide, inorganic peroxides, organic metal compounds, and photopolymerization initiators. More specifically, examples thereof include azo polymerization initiators such as 2,2'-azobis(isobutyronitrile), 2,2'-azobis(2-methylbutyronitrile), 2,2'-azobis(4-methoxy-2,4-dimethylvaleronitrile), 2,2'-azobis(2,4-dimethylvaleronitrile), and dimethyl-2,2'-azobis (isobutyrate); organic peroxide polymerization initiators such as benzoyl peroxide, di-tert-butyl peroxide, tert-butylperoxy isopropyl monocarbonate, tert-hexyl peroxy benzoate, and tert-butyl peroxy benzoate; inorganic peroxide polymerization initiators such as potassium persulfate and ammonium persulfate; and redox initiators such as hydrogen peroxide-ferrous initiators, BPO-dimethylaniline initiators, cerium (IV) salt-alcohol initiators. Examples of the photopolymerization initiator include acetophenone initiators, benzoin ether initiators, and ketal initiators. These methods can be used alone, or two or more thereof can be used in combination.

The concentration of the polymerization initiator is preferably in the range of 0.1 to 20 parts by mass, and more preferably 0.1 to 10 parts by mass based on 100 parts by mass of the polymerizable monomer. The kind of the polymerization initiator depends on the polymerization methods. The polymerization initiator is used alone, or mixed and used referring to a 10 hour half-life temperature.

The water-based medium used in the suspension polymerization method preferably contains a dispersion stabilizer. As the dispersion stabilizer, known inorganic and organic dispersion stabilizers can be used. Examples of the inorganic dispersion stabilizer include calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of the organic dispersion stabilizer include polyvinyl alcohol, gelatin, methyl cellulose, methyl hydroxypropyl cellulose, ethyl cellulose, and sodium salt of carboxymethyl cellulose, and starch. Nonionic, anionic, and cationic surfactants can also be used. Examples thereof include sodium dodecyl sulfate, sodium tetradecyl sulfate, sodium pentadecyl sulfate, sodium octyl sulfate, sodium oleate, sodium laurate, potassium stearate, and calcium oleate.

Among the dispersion stabilizers, preferred is use of a less water-soluble inorganic dispersion stabilizer having solubility in an acid. These dispersion stabilizers are preferably used in a proportion of 0.2 to 2.0 parts by mass based on 100 parts by mass of the polymerizable monomer from the viewpoint of stability of the droplets in the water-based medium. In the present invention, 300 to 3,000 parts by mass of water based on 100 parts by mass of the polymerizable monomer composition is preferably used to prepare the water-based medium.

In the present invention, in the case where the water-based medium is prepared in which the less water-soluble inorganic dispersion stabilizer is dispersed, a commercially available dispersion stabilizer may be used as it is and dispersed. In order to obtain a dispersion stabilizer particle having a fine and uniform particle size, preferably, the less water-soluble inorganic dispersion stabilizer is produced in water under high speed stirring and prepared. For example, in the case where calcium phosphate is used as the dispersion stabilizer, a sodium phosphate aqueous solution is mixed with a calcium chloride aqueous solution under high speed stirring to form fine particles of calcium phosphate. Thereby, a preferred dispersion stabilizer can be obtained.

<Method for Producing Toner by Suspension Granulation Method>

A suitable toner particle can be obtained in the case where the toner particle is produced by the suspension granulation method. The production step in the suspension granulation method does not include a heating step. For this reason, the resin becoming compatible with the wax, which occurs when a low melting point wax is used, can be suppressed to prevent reduction in the glass transition temperature of the toner attributed to the compatibility. Moreover, the suspension granulation method has a wider choice of the toner materials for the binder resin. Usually, it is easy to use a polyester resin as the main component, the polyester resin being advantageous in fixing properties. For this reason, this is a production method advantageous in the case of production of a toner having a resin composition that cannot be used in the suspension polymerization method.

In the suspension granulation method, the toner particle is produced as follows, for example.

First, the colorant containing the colorant dispersion, the binder resin, the wax component, and the like are mixed in a solvent to prepare a solvent composition. Next, the solvent composition is dispersed in the water-based medium, and the particle of the solvent composition is granulated to obtain a toner particle suspension. Then, the solvent is removed by heating the obtained suspension or reducing pressure. Thereby, a toner particle can be obtained.

Examples of the solvent usable in the suspension granulation method include hydrocarbons such as toluene, xylene, and hexane; halogen-containing hydrocarbons such as methylene chloride, chloroform, dichloroethane, trichloroethane, and carbon tetrachloride; alcohols such as methanol, ethanol, butanol, and isopropyl alcohol; polyhydric alcohols such as ethylene glycol, propylene glycol, diethylene glycol, and triethylene glycol; cellosolves such as methyl cellosolve and ethyl cellosolve; ketones such as acetone, methyl ethyl ketone, and methyl isobutyl ketone; ethers such as benzyl alcohol ethyl ether, benzyl alcohol isopropyl ether, and tetrahydrofuran; and esters such as methyl acetate, ethyl acetate, and butyl acetate. These can be used alone, or two or more thereof can be mixed and used. Among these, in order to easily remove the solvent in the toner particle suspension, preferred is a solvent having a low boiling point and being capable of sufficiently dissolving the binder resin.

The amount of the solvent to be used is preferably in the range of 50 to 5,000 parts by mass, and more preferably 120 to 1,000 parts by mass based on 100 parts by mass of the binder resin.

The water-based medium used in the suspension granulation method preferably contains a dispersion stabilizer. As the dispersion stabilizer, known inorganic and organic dispersion stabilizers can be used. Examples of the inorganic dispersion stabilizer include calcium phosphate, calcium carbonate, aluminum hydroxide, calcium sulfate, and barium carbonate. Examples of the organic dispersion stabilizer include water-soluble polymers such as polyvinyl alcohol, methyl cellulose, hydroxyethyl cellulose, ethyl cellulose, sodium salt of carboxymethyl cellulose, sodium polyacrylate, and sodium polymethacrylate; and surfactants, i.e., anionic surfactants such as sodium dodecylbenzenesulfonate, octadecyl sodium sulfate, sodium oleate, sodium laurate, and potassium stearate; cationic surfactants such as laurylamine acetate, stearylamine acetate, and lauryltrimethylammonium chloride; amphoteric surfactants such as lauryldimethylamine oxide; and nonionic surfactants such as polyoxyethylene alkyl ether, polyoxyethylene alkylphenyl ether, and polyoxyethylene-alkylamine.

The amount of the dispersant is preferably in the range of 0.01 to 20 parts by mass based on 100 parts by mass of the binder resin from the viewpoint of the stability of the droplet of the solvent composition in the water-based medium.

<Method for Producing Liquid Developer>

Hereinafter, as the production method according to the present invention, a method for producing a liquid developer will be described.

First, to obtain the liquid developer according to the present invention, as the colorant, the compound represented by the formula (1), the dispersant resin used as the dispersant, and when necessary, aids such as a charge control agent and wax are dispersed or dissolved in an electrically insulating carrier solution to produce a liquid developer. Alternatively, the liquid developer may be prepared by a two-stage method in which a condensed toner is produced in advance, and diluted with an electrically insulating carrier solution to prepare a developer.

The dispersing machine used in the present invention is not particularly limited. For example, preferably used are a media dispersing machine such as a rotary shear type homogenizer, a ball mill, a sand mill, and an Attritor, and a counter collision dispersing machine.

The colorant used in the present invention can be used alone, or in combination with two or more of the compound represented by the formula (1). Alternatively, the colorant can be used in combination with two or more of known magenta pigments and dyes.

The resin and wax used in the present invention are the same as above.

The charge control agent using the present invention is not particularly limited and is any charge control agent used for the liquid developer for electrostatic development. Examples thereof include cobalt naphthenate, copper naphthenate, copper oleate, cobalt oleate, zirconium octylate, cobalt octylate, sodium dodecylbenzenesulfonate, calcium dodecylbenzenesulfonate, soy lecithin, and aluminum octoate.

The electrically insulating carrier solution used in the present invention is not particularly limited. For example, preferred is use of an organic solvent having a high electric resistance of not less than $10^9$ Ω·cm and a low permittivity of not more than 3.

Specific examples of preferable electrically insulating carrier solutions include aliphatic hydrocarbon solvents such as hexane, pentane, octane, nonane, decane, undecane, and dodecane; and those having a boiling point of 68 to 250° C. such as Isopars H, G, K, L, and M (made by Exxon Chemical Company); LINEALENE Dimers A-20 and A-20H (made by Idemitsu Kosan Co. Ltd.). These may be used alone, or two or more thereof may be used in combination in the range in which the viscosity of the system is not increased.

<Production of Toner by Pulverization Method>

In production of the toner by the pulverization method, materials, i.e., the binder resin and the colorant, when necessary, a magnetic body, a wax, a charge control agent, and other additives are sufficiently mixed by a mixer such as Henschel mixer or a ball mill. Subsequently, the mixture is melt kneaded using a heat kneader such as a roll, a kneader, and an extruder. Then, the resins are compatible with each other by kneading, and the wax or the magnetic body is dispersed therein. After cooling and solidifying, the obtained product is crushed and classified. Thereby, a toner can be obtained.

The toner can be produced by a known production apparatus. For example, the production apparatuses below can be used depending on the situations.

As the toner production apparatus, examples of mixers include a Henschel mixer (made by Mitsui Mining Co., Ltd.); a SUPERMIXER (made by KAWATAMFG Co., Ltd.); Ribocone (made by Okawara Mfg. Co., Ltd.); a Nauta Mixer, a Turbulizer, and a Cyclomix (made by Hosokawa Micron Corporation); a spiral pin mixer (made by Hosokawa Micron Corporation); and a Loedige mixer (made by MATSUBO Corporation).

Examples of a kneader include a KRC kneader (made by Kurimoto, Ltd.); a Buss Cokneader (made by Buss AG); a TEM extruder (made by TOSHIBA MACHINE CO., LTD.); a TEX twin screw kneader (made by The Japan Steel Works, Ltd.); a PCM kneader (made by Ikegai Ironworks Corp.); a three-roll mill, a mixing roll mill, and a kneader (made by INOUE MANUFACTURING CO., LTD.); a Kneadex (made by Mitsui Mining Co., Ltd.); an MS pressure kneader and a Kneader-Ruder (made by MORIYAMA COMPANY LTD.); and a Banbury mixer (made by Kobe Steel, Ltd.).

Examples of a mill include a Counter Jet Mill, a Micro Jet, and an Inomizer (made by Hosokawa Micron Corporation); an IDS mill and a PJM jet mill (made by Nippon Pneumatic Mfg. Co., Ltd.); a cross jet mill (made by Kurimoto, Ltd.); an ULMAX (made by NISSO ENGINEERING CO., LTD.); an SK Jet-O-Mill (made by Seishin Enterprise Co., Ltd.); a CRYPTRON (made by Kawasaki Heavy Industries, Ltd.); a turbo mill (made by FREUND-TURBO CORPORATION); and a super rotor (made by NISSHIN ENGINEERING INC.).

Examples of a classifier include a Crushiel, a Micron Classifier, and a Spedic Classifier (made by Seishin Enterprise Co., Ltd.); a turbo classifier (made by NISSHIN ENGINEERING INC.); a micron separator, a Turboplex (ATP), and a TSP separator (made by Hosokawa Micron Corporation); an Elbow-jet (made by Nittetsu Mining Co., Ltd.); a dispersion separator (made by Nippon Pneumatic Mfg. Co., Ltd.); and a YM Micro Cut (made by YASKAWA & CO., LTD.).

Examples of a sieving apparatus used to sieve coarse particles include an Ultrasonic (made by Koei Sangyo Co., Ltd.); a Resonasieve and a Gyroshifter (TOKUJU CORPORATION); a Vibrasonic system (made by DALTON CORPORATION); a SONICLEAN (made by SINTOKOGIO, LTD.); a turbo screener (made by FREUND-TURBO CORPORATION); a MICROSIFTER (made by Makino mfg Co., Ltd.); and a circular vibrating sieve.

In the toner, a masterbatch prepared by mixing the compound represented by the formula (1) as the colorant in the binder resin in advance is preferably used. The colorant masterbatch and other raw materials (the binder resin, the wax, and the like) are melt kneaded. Thereby, the colorant can be dispersed well in the toner.

In the case where the masterbatch is prepared by mixing the colorant in the binder resin, the dispersibility of the colorant is not reduced even by use of a large amount of the colorant. Moreover, the dispersibility of the colorant in the toner particle is improved, providing high color reproducibility such as color mixing properties and transparency. Further, a toner having a great covering power on a transfer material can be obtained. Moreover, the improved dispersibility of the colorant can provide high durable stability of the charging properties in the toner, resulting in an image that can keep high quality.

The amount of the colorant to be used is preferably 0.1 to 30 parts by mass, more preferably 0.5 to 20 parts by mass, and most preferably 3 to 15 parts by mass based on 100 parts by mass of the binder resin.

EXAMPLES

Hereinafter, the present invention will be described more in detail using Examples and Comparative Examples, but the present invention will not be limited to these Examples. Herein, "parts" and "%" are based on mass unless otherwise specified.

The obtained reaction products were identified by a plurality of analysis methods using the apparatuses below. Namely, the analyzers used were a $^{1}H$ and $^{13}C$ nuclear magnetic resonance spectrometer (ECA-400, made by JEOL, Ltd.), an LC/TOF MS (LC/MSD TOF, made by Agilent Technologies), and UV/Vis spectrophotometer (UV-36000 spectrophotometer made by Shimadzu Corporation). Ionization in the LC/TOF MS used was electrospray ionization (ESI).

<Production of Compound Represented by Formula (1)>

The compound represented by the formula (1) according to the present invention can be synthesized by a known method.

The compound represented by the formula (1) according to the present invention was produced by a method described below.

Production Example 1

Production Example of Compound (2)

102 g of acetic anhydride was placed in a 20 g 1,2-dichlorobenzene solution of 76.9 g of 4-bromo1-cyclohexylaminoanthraquinone, and 1 g of concentrated sulfuric acid was placed to the solution. The solution was stirred at 110° C. for 6 hours. After the reaction was completed, the solution was diluted with 1000 g of methanol and filtered to obtain 59.8 g of 1-(acetylcyclohexylamino)-4-bromoanthraquinone (yield of 70.1%). Further, a solution of 12 g of sodium hydroxide/150 g of water was dropped to a 150 g isobutanol solution of 1-(acetylcyclohexylamino)-4-bromoanthraquinone, and the obtained solution was stirred at 90° C. for 6 hours. After the reaction was completed, the solution was cooled, the obtained solid was filtered to obtain 28.7 g of 4-bromo-1,9-N-cyclohexylanthrapyridone (70.4%). Next, 25.8 g of 2-ethylhexylamine, 8.6 g of sodium carbonate, and 6.8 g of copper powder were placed in a 40 g 1,3-dimethyl-2-imidazolidine solution of 20.4 g of 4-bromo-1,9-N-cyclohexylanthrapyridone, and the reaction was made at 190° C. for 4 hours. After the reaction was completed, the solution was cooled, diluted with ethyl acetate, and filtered. Column chromatography refining (toluene/THF) was performed to obtain 18 g of a compound (2) (yield of 82.7%). FIG. 1 illustrates a $^{1}H$ NMR spectrum of the compound (2) in $CDCl_3$ at room temperature and 400 MHz.

<Result of Analysis of Compound (2)>

[1] $^{1}H$ NMR (400 M Hz, $CDCl_3$, room temperature): δ [ppm]=0.95 (td, 3H, J=15.1, 7.79 Hz), 1.34-1.59 (m, 1H), 1.66 (s, 2H), 1.87 (tt, 6H, J=41.7, 10.5 Hz), 3.35 (dt, 2H, J=16.2, 6.53 Hz), 7.20 (d, 1H, J=10.1 Hz), 7.65-7.75 (m, 3 Hz), 8.00 (s, 1H), 8.24 (d, 1H, J=7.79 Hz), 8.52 (dd, 1H, J=7.79, 1.37 Hz), 10.7 (s, 1H)

[2] Mass spectrometry (ESI-TOF): m/z=457.2850 $(M+H)^{+}$

<Production Examples of Other Dye Compounds>

Other compounds shown in Table 1 below were synthesized according to the method in Production Example 1. The structures of these compounds were checked in the same manner as in the case of the compound.

<Result of Analysis of Compound (3)>

[1] $^{1}H$ NMR (400 M Hz, $CDCl_3$, room temperature): δ [ppm]=0.97 (tt, 8H, J=20.8, 7.17 Hz), 1.36 (dd, 4H, J=9.16, 5.50 Hz), 1.48-1.60 (m, 5H), 1.64 (s, 2H), 1.78 (dt, 3H, J=20.2, 6.98 Hz), 3.34-3.39 (m, 2H), 4.42 (t, 2H, J=7.79 Hz), 7.25 (t, 2H, J=6.18 Hz), 7.65-7.76 (m, 4 Hz), 8.24 (d, 1H, J=7.79 Hz), 8.53 (dd, 1H, J=7.79, 1.37 Hz), 10.7 (s, 1H)

[2] Mass spectrometry (ESI-TOF): m/z=430.9556 $(M+H)^{+}$

<Result of Analysis of Compound (4)>

[1] $^{1}H$ NMR (400 M Hz, $CDCl_3$, room temperature): δ [ppm]=0.91 (td, 6H, J=14.7, 7.48 Hz), 1.29-1.58 (m, 12H), 1.68 (s, 2H), 1.90 (dd, 3H, J=21.5, 7.79 Hz), 2.14 (t, 2H, J=13.5 Hz), 3.66 (s, 1H), 4.37 (s, 2H), 7.25 (t, 1H, J=6.87 Hz), 7.63-7.76 (m, 4 Hz), 8.24 (d, 1H, J=7.79 Hz), 8.51 (dd, 1H, J=8.01, 1.60 Hz), 10.7 (d, 1H, J=7.79 Hz)

[2] Mass spectrometry (ESI-TOF): m/z=456.8830 $(M+H)^{+}$

Result of Analysis of Compound (5)>

[1] $^{1}H$ NMR (400 M Hz, $CDCl_3$, room temperature): δ [ppm]=0.93 (tt, 12H, J=19.7, 7.48 Hz), 1.29-1.60 (m, 15H), 1.76 (td, 2H, J=13.5, 7.94 Hz), 1.92 (t, 1H, J=6.18 Hz), 3.35 (dt, 2H, J=15.9, 6.41 Hz), 4.36 (s, 2H), 7.21 (d, 1H, J=9.62 Hz), 7.64-7.75 (m, 4 Hz), 8.23 (d, 1H, J=7.33 Hz), 8.52 (dd, 1H, J=7.79, 1.37 Hz), 10.7 (s, 1H)

[2] Mass spectrometry (ESI-TOF): m/z=487.9323 $(M+H)^{+}$

<Result of Analysis of Compound (6)>

[1] $^{1}H$ NMR (400 M Hz, $CDCl_3$, room temperature): δ [ppm]=0.98 (dt, 6H, J=35.7, 7.33 Hz), 1.35-1.64 (m, 8H), 1.75-1.82 (m, 2H), 2.02-2.09 (m, 2H), 3.46 (t, 2H, J=6.64 Hz), 4.42 (t, 2H, J=7.79 Hz), 7.28 (t, 2H, J=8.47 Hz), 7.70 (ddd, 4 Hz, J=25.3, 11.8, 5.61 Hz), 8.25 (d, 1H, J=7.79 Hz), 8.51 (t, 1H, J=4.58 Hz), 10.6 (s, 1H)

[2] Mass spectrometry (ESI-TOF): m/z=433.2524 $(M+H)^{+}$

<Result of Analysis of Compound (7)>

[1] $^{1}H$ NMR (400 M Hz, $CDCl_3$, room temperature): δ [ppm]=0.86-0.90 (m, 6H), 1.02 (t, 3H, J=7.33 Hz), 1.34 (ddd, 8H, J=30.3, 17.1, 6.75 Hz), 1.62 (s, 3H), 1.79 (t, 2H, J=7.79), 2.05 (t, 2H, J=6.18 Jz), 3.34 (d, 2H, J=5.95 Hz), 3.54-3.60 (m, 4H), 4.42 (t, 2H, J=7.79 Hz), 7.29 (t, 1H, J=9.16 Hz), 7.70 (dq, 4 Hz, J=24.8, 6.03 Hz), 8.25 (d, 1H, J=7.79 Hz), 8.51 (dd, 1H, J=8.01, 1.60 Hz), 10.6 (s, 1H)

[2] Mass spectrometry (ESI-TOF): m/z=489.3205 $(M+H)^{+}$

<Result of Analysis of Compound (8)>

[1] $^{1}H$ NMR (400 M Hz, $CDCl_3$, room temperature): δ [ppm]=0.88 (t, 3H, J=6.87 Hz), 1.02 (t, 3H, J=7.33 Hz), 1.20-1.30 (m, 16H), 1.53 (m, 4H), 1.80 (dt, 4H, J=15.5, 8.55), 3.43 (q, 2H, J=6.41 Hz), 4.43 (t, 2H, J=7.79 Hz), 7.24 (t, 1H, J=7.10 Hz), 7.66-7.77 (m, 4 Hz), 8.25 (d, 1H, J=7.33 Hz), 8.52 (dd, 1H, J=7.79, 1.37 Hz), 10.6 (s, 1H)

[2] Mass spectrometry (ESI-TOF): m/z=487.3319 $(M+H)^{+}$

<Result of Analysis of Compound (9)>

[1] $^1$H NMR (400 M Hz, $CDCl_3$, room temperature): δ [ppm]=1.02 (t, 3H, J=7.33 Hz), 1.48-1.81 (m, 8H), 2.04 (t, 4H, J=7.56 Hz), 2.42 (t, 2H, J=7.10 Hz), 3.48 (dd, 2H, J=12.4, 7.33 Hz), 4.39 (t, 2H, J=7.79 Hz), 5.65 (s, 1H), 7.21 (d, 1H, J=9.62 Hz), 7.68 (tt, 4 Hz, J=17.2, 7.40 Hz), 8.21 (d, 1H, J=8.24 Hz), 8.49 (d, 1H, J=7.79 Hz), 10.5 (s, 1H)

[2] Mass spectrometry (ESI-TOF): m/z=427.2431 $(M+H)^+$

<Result of Analysis of Compound (10)>

[1] $^1$H NMR (400 M Hz, $CDCl_3$, room temperature): δ [ppm]=1.01 (t, 3H, J=7.33 Hz), 1.51 (dd, 2H, J=15.1, 7.33 Hz), 7.75 (t, 2H, J=6.87), 2.13 (t, 2H, J=7.33 Hz), 8.84 (t, 2H, J=7.56 Hz), 3.39 (q, 2H, J=6.41 Hz), 4.35 (d, 2H, J=7.79 Hz), 7.09 (d, 1H, J=9.62 Hz), 7.23 (t, 3H, J=6.64 Hz), 7.31 (t, 2H, J=7.56 Hz), 7.57 (d, 1H, J=9.62 Hz), 7.62-7.73 (m, 3 Hz), 8.18 (d, 1H, J=7.79 Hz), 8.47 (d, 1H, J=6.41 Hz), 10.6 (s, 1H)

[2] Mass spectrometry (ESI-TOF): m/z=437.2225 $(M+H)^+$

Synthesis Examples of the dye compounds synthesized above and measurement results of the wavelength are shown in Table 1. In the compounds in Table 1, "*" represents a bonding side of a substituent.

<Production Example of Resin Particle Dispersion Liquid>

82.6 parts of styrene, 9.2 parts of n-butyl acrylate, 1.3 parts of acrylic acid, 0.4 parts of hexanediol acrylate, and 3.2 parts of n-laurylmercaptan were mixed and dissolved. A 150 parts ion exchange water aqueous solution of 1.5 parts of NEOGEN RK (made by Dai-ichi Kogyo Seiyaku Co., Ltd.) was added to the solution, and dispersed. Further, while the solution was slowly stirred for 10 minutes, a 10 parts ion exchange water aqueous solution of 0.15 parts of potassium persulfate was added. After replacement with nitrogen, emulsion polymerization was performed at 70° C. for 6 hours. After the polymerization was completed, the reaction solution was cooled to room temperature, and ion exchange water was added. Thereby, a resin particle dispersion liquid (1) was obtained in which the concentration of the solid content was 12.5% by mass, and the median particle size based on the volume was 0.2 μm.

<Method for Producing Colorant Particle Dispersion Liquid>

100 parts of the compound (1), and 15 parts of NEOGEN RK were mixed with 885 parts of ion exchange water, and

TABLE 1

| | Compound | $R_1$ | $R_2$ | λex |
|---|---|---|---|---|
| Synthesis Example 1 | 1 | $CH_3$ | 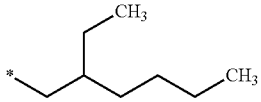 | 548 |
| Synthesis Example 2 | 2 | 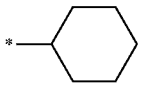 | 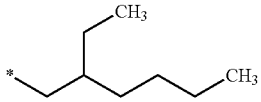 | 546 |
| Synthesis Example 3 | 3 | n-Bu | 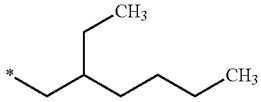 | 547 |
| Synthesis Example 4 | 4 | 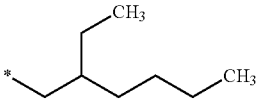 | 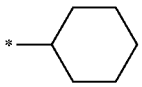 | 550 |
| Synthesis Example 5 | 5 | 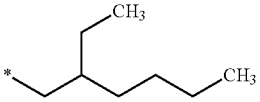 | 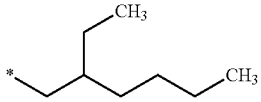 | 549 |
| Synthesis Example 6 | 6 | n-Bu | 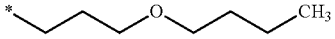 | 544 |
| Synthesis Example 7 | 7 | n-Bu | 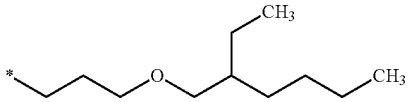 | 544 |
| Synthesis Example 8 | 8 | n-Bu | 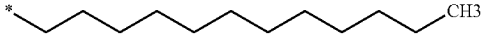 | 545 |
| Synthesis Example 9 | 9 | n-Bu | 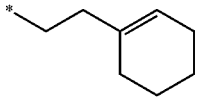 | 544 |
| Synthesis Example 10 | 10 | n-Bu | 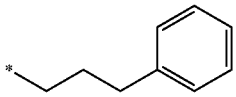 | 547 |

dispersed for approximately 1 hour using a wet jet mill JN100 (made by Jokoh Co., Ltd.) to obtain a colorant particle dispersion (1). In the colorant particle dispersion, the median particle size based on the volume of the colorant particle was 0.2 μm, and the concentration of the colorant particle was 10% by mass.

<Method for Producing Wax Particle Dispersion Liquid>

100 parts of ester wax (peak temperature of the largest endothermic peak in DSC measurement=70° C., Mn=704) and 15 parts of NEOGEN RK were mixed with 385 parts of ion exchange water, and dispersed for approximately 1 hour using a wet jet mill JN100 (made by Jokoh Co., Ltd.) to obtain a wax particle dispersion liquid (1). The concentration of the wax particle dispersion liquid was 20% by mass.

Example 1

160 parts of the resin particle dispersion liquid (1), 10 parts of the colorant particle dispersion (1), 10 parts of the wax particle dispersion liquid (1), and 0.2 parts of magnesium sulfate were dispersed using a homogenizer (ULTRA-TURRAX T50, made by IKA Works GmbH & Co. KG). Then, while the solution was stirred, the heating was performed to 65° C. After stirring at 65° C. for 1 hour, the solution was observed by an optical microscope. It was found that an aggregate particle having the average particle size of approximately 6.0 μm was formed. 2.2 parts of NEOGEN RK (made by Dai-ichi Kogyo Seiyaku Co., Ltd.) was added, and the temperature was raised to 80° C., followed by stirring for 120 minutes. Thereby, a fused spherical toner particle was obtained. After cooling, the solution was filtered, then the filtered solid was stir washing with 720 parts of ion exchange water for 60 minutes. The solution containing the toner particle was filtered. The same washing was repeated until the electric conductivity of the filtrate reached not more than 150 μS/cm. The solid was dried by a vacuum dryer to obtain a toner base particle (1).

The electric conductivity of the filtrate was calculated according to the method described in Japanese Patent Application Laid-Open No. 2006-243064. Namely, 30 parts of the initial filtrate was discarded, and the temperature of the remaining filtrate was raised to 25±0.5° C. Then, the filtrate was measured by an electric conductivity meter (ES-12, made by HORIBA, Ltd.), and the electric conductivity of the sample was calculated by the following equation:

$$\text{electric conductivity } (\mu S/cm) = A - B$$

A: electric conductivity of the filtrate

B: electric conductivity of water used for washing

The ion exchange water having an electric conductivity of not more than 5 μS/cm and a pH of 7.0±1.0 was used. 1.8 parts of hydrophobized silica fine powder whose specific surface area measured by the BET method was 200 $m^2/g$ was dry mixed with 100 parts of the obtained toner base particle (1) by a Henschel mixer (made by Mitsui Mining Co., Ltd.) to obtain a toner (1). Further, 95 parts of a ferrite carrier having an acrylic coating was mixed with 5 parts of the obtained toner (1) to prepare a two-component developer. The two-component developer was used to perform a durability test of 10,000 sheets under an environment of 15° C./10% RH using a modified machine of the CLC-1100 made by Canon Inc. (the fixing oil applying mechanism was removed). Fogging was visually observed in the initial period of the test and after the test. As a result, a good image having no fogging was obtained in the initial period of the test and after the test.

Examples 2 to 7

Toners (2) to (7) were obtained in the same manner as in Example 1 except that compounds (2) to (7) shown in Table 2 were used instead of the compound (1) in the method according to the production of the colorant particle dispersion liquid (1) in the Example 1. The same evaluation as in Example 1 was performed on the obtained toners.

Comparative Examples 1 to 5

Toners for comparison (1) to (5) were obtained in the same manner as in Example 1 except that the compounds for comparison (1) to (5) having the structures shown in Table 2 below were used instead of the compound (1) in the method according to the production of the colorant particle dispersion liquid (1) in Example 1. The same evaluation as in Example 1 was performed on the obtained toners.

Compound for comparison (1)

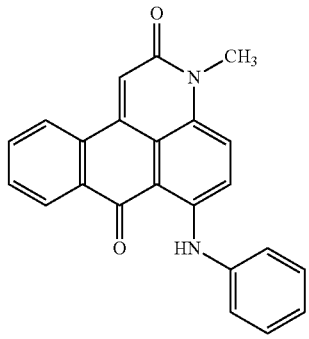

Compound for comparison (2)

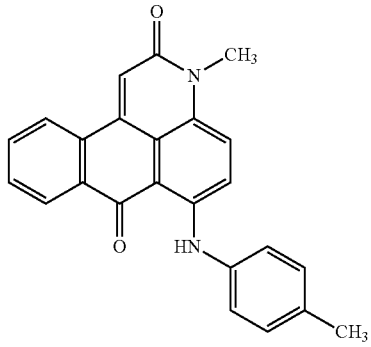

Compound for comparison (3)

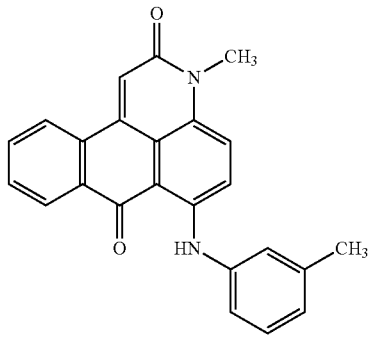

-continued

Compound for comparison (4)

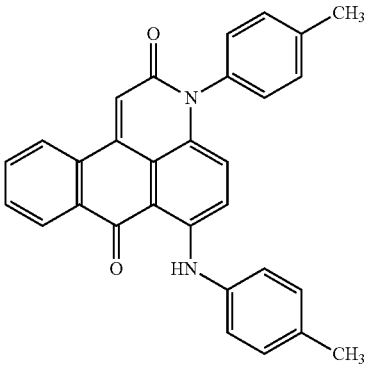

Compound for comparison (5)

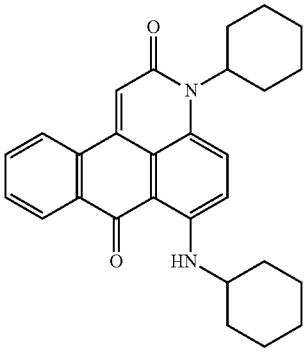

Example 8

A mixture of 12 parts of a compound (2), and 120 parts of styrene were dispersed by an Attritor (made by Mitsui Mining Co., Ltd.) for 3 hours to obtain a pigment dispersion (1).

710 parts of ion exchange water and 450 parts of a 0.1 mol/L trisodium phosphate aqueous solution were added to a 2-L four-necked flask including a high speed stirrer T.K. homomixer (made by PRIMIX Corporation). The number of rotation was adjusted to 12,000 rpm, and the heating was performed to 60° C. 68 parts of a 1.0 mol/L calcium chloride aqueous solution was added to the flask little by little to prepare a water-based dispersion medium containing a fine calcium phosphate (less water-soluble dispersion stabilizer).

| | |
|---|---|
| pigment dispersion (1) | 132.0 parts |
| styrene monomer | 46.0 parts |
| n-butylacrylate monomer | 34.0 parts |
| aluminum salicylate compound (made by ORIENT CHEMICAL INDUSTRIES CO., LTD., BONTRON E-88) | 2.0 parts |
| polar resin (polycondensate of propylene oxide-modified bisphenol A and isophthalic acid, Tg = 65° C., Mw = 10,000, Mn = 6,000) | 10.0 parts |
| ester wax (peak temperature of the largest endothermic peak in DSC measurement = 70° C., Mn = 704) | 25.0 parts |
| divinylbenzene monomer | 0.10 parts |

The formula was heated to 60° C., and uniformly dissolved and dispersed at 5,000 rpm using a T.K. homomixer. 10 parts of 2,2'-azobis(2,4-dimethylvaleronitrile) as the polymerization initiator was dissolved in the obtained solution to prepare a polymerizable monomer composition.

The polymerizable monomer composition was put into the water-based medium, and granulated for 15 minutes while the number of rotation was kept at 12,000 rpm. Then, the high speed stirrer was replaced by a propeller stirring blade. The polymerization was continued at a temperature of the solution of 60° C. for 5 hours. Subsequently, the temperature of the solution was raised to 80° C., and the polymerization was continued for 8 hours. After the polymerization reaction was completed, the remaining monomer was removed at 80° C./under reduced pressure, and the temperature of the solution was cooled to 30° C. to obtain a polymer fine particle dispersion.

Next, the polymer fine particle dispersion was placed in a washing container. While the dispersion was stirred, diluted hydrochloric acid was added to adjust the pH to 1.5. Stirring was performed for 2 hours. Solid liquid separation was performed using a filter to obtain a polymer fine particle. Redispersion of the polymer fine particle in water and solid liquid separation were repeated until the dispersion stabilizer was sufficiently removed. Subsequently, the polymer fine particle subjected to solid liquid separation finally was sufficiently dried by a dryer to obtain a magenta toner base particle.

Based on 100 parts of the obtained magenta toner base particle, 1.00 part of hydrophobic silica fine powder surface treated with hexamethyldisilazane (number average size of the primary particle of 7 nm), 0.15 parts of rutile titanium oxide fine powder (number average size of the primary particle of 45 nm), and 0.50 parts of rutile titanium oxide fine powder (number average size of the primary particle of 200 nm) were dry mixed for 5 minutes by a Henschel mixer (made by NIPPON COKE & ENGINEERING CO., LTD.) to obtain a toner (8).

The magenta toner was evaluated as follows. The result of evaluation is shown in Table 2 described later.

<Measurement of Weight Average Particle Size D4 and Number Average Particle Size of Toner D1>

The number average particle size (D1) and weight average particle size (D4) of the toner particle were measured by a particle size distribution analysis according to the Coulter method. Using a Coulter Counter TA-II or a Coulter Multisizer II (made by Beckman Coulter, Inc.) as the measurement apparatus, the measurement was performed according to the operation manual of the apparatus. First grade sodium chloride was used as the electrolyte solution, an approximately 1% sodium chloride aqueous solution was prepared. For example, an ISOTON-II (made by Coulter Scientific Japan, K.K.) can be used. As a specific measurement method, 0.1 to 5 ml of a surfactant (preferably, alkylbenzenesulfonic acid salt) as a dispersant was added to 100 to 150 mL of the electrolytic aqueous solution, and 2 to 20 mg of the sample to be measured (toner particle) was added. The electrolyte solution having the sample suspended was dispersed by an ultrasonic disperser for approximately 1 to 3 minutes. Using the obtained dispersion solution, the volume and number of the toner having a particle size of not less than 2.00 μm were measured by the measurement apparatus to which an aperture of 100 μm was mounted. The volume distribution and number distribution of the toner were calculated. Then, the number average particle size (D1), weight average particle size (D4) of the toner particle (the median in each channel was used as a representative value of each channel) and D4/D1 were determined.

The channels used are 13 channels of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm. Apparently from Table 2, it was found that the proportions of coarse powder and fine powder are increased in Comparative Examples compared to Examples.

<Measurement of Average Circularity of Toner>

Measurement was performed using a flow type particle image measurement apparatus "FPIA-2100" (made by Sysmex Corporation), and the average circularity of the toner was calculated using the following equation:

$$\text{Equivalent circle diameter} = \sqrt{\text{Projected area of particle}/\pi} \times 2$$

$$\text{Circularity} = \frac{\text{Circumferential length of circle having the same area as projected area of particle}}{\text{Circumferential length of projected image of particle}}$$

Here, the "projected area of the particle" is an area of a binarized toner particle image, and the "circumferential length of the projected image of the particle" defines the length of the outline obtained by connecting edge points of the toner particle. The circularity is an index representing a degree of depressions and projections of the particle. It designates 1.000 when the particle has a perfect spherical shape, and the value of the circularity is smaller as the shape of the surface is more complicated.

<Evaluation of Lightness and Saturation of Image Sample>

Using the obtained two-component developer and the obtained toner (i.e. one-component developer), some image samples each changing quantity of toner were output, and chromaticity (L*, a*, b*) was measured. The Lab curves were drawn by plotted L*, a* and b* of image samples. A modified machine of the CLC-1100 made by Canon Inc. (the fixing oil applying mechanism was removed) was used as an image forming apparatus for evaluating two-component developers. And a modified LBP-5300 (made by Canon Inc.) was used as an image forming apparatus for evaluating one-component developers. In the modified LBP-5300, a developing blade with in a process cartridge was replaced by an SUS blade having a thickness of 8 μm. Additionally, modification was made such that a blade bias of −200 [V] could be applied to a developing bias applied to a developing roller as a toner carrier.

Using a SpectroLino made by Gretag Macbeth GmbH, the optical density and chromaticity in the L*a*b* color system (L*, a*, b*) were measured.

In a Lab space, the C* value of each sample at a point of intersection of a plane including the L axis and Japan Color 2001 and the Lab curve of each image sample obtained by the chromaticity measurement, the difference of the C* value in Japan Color 2001, and the difference between the distance of the point of intersection from the origin and the distance of Japan Color 2001 from the origin were evaluated, and the lightness and saturation were determined.

A: the difference on the ab plane is not less than 0, and the difference on the Lab space is not less than −5 (lightness and saturation are very good)

B: the difference on the ab plane is not less than 0, and the difference on the Lab space is not less than −15 and less than −5 (lightness and saturation are good)

C: the difference on the ab plane is less than 0, or the difference on the Lab space is less than −15 (lightness and saturation are bad)

TABLE 2

| | Compound | Toner | D4 (μm) | D4/D1 | Average circularity | L* | a* |
|---|---|---|---|---|---|---|---|
| Example 1 | 1 | 1 | 4.8 | 1.28 | 0.984 | 60.0 | 73.1 |
| Example 2 | 2 | 2 | 4.7 | 1.28 | 0.988 | 66.7 | 71.0 |
| Example 3 | 3 | 3 | 5.0 | 1.27 | 0.987 | 61.7 | 77.4 |
| Example 4 | 4 | 4 | 5.1 | 1.27 | 0.982 | 62.2 | 77.5 |
| Example 5 | 5 | 5 | 5.3 | 1.35 | 0.985 | 61.2 | 77.9 |
| Example 6 | 6 | 6 | 5.4 | 1.40 | 0.979 | 64.2 | 72.8 |
| Example 7 | 7 | 7 | 5.3 | 1.38 | 0.974 | 69.3 | 64.1 |
| Example 8 | 2 | 8 | 5.9 | 1.41 | 0.976 | 66.4 | 72.4 |
| Example 10 | 8 | 9 | 6.0 | 1.29 | 0.979 | 60.4 | 76.2 |
| Example 11 | 10 | 10 | 6.0 | 1.31 | 0.981 | 61.0 | 75.1 |
| Example 12 | 5 | 11 | 6.0 | 1.43 | 0.922 | 61.5 | 78.2 |
| Comparative Example 1 | Compound for comparison 1 | Toner for comparison (1) | 5.5 | 1.53 | 0.977 | 18.6 | 52.3 |
| Comparative Example 2 | Compound for comparison 2 | Toner for comparison (2) | 5.7 | 1.59 | 0.984 | 19.8 | 47.2 |
| Comparative Example 3 | Compound for comparison 3 | Toner for comparison (3) | 5.3 | 1.53 | 0.979 | 9.0 | 27.9 |
| Comparative Example 4 | Compound for comparison 4 | Toner for comparison (4) | 6.1 | 1.60 | 0.966 | 33.0 | 48.4 |
| Comparative Example 5 | Compound for comparison 5 | Toner for comparison (5) | 5.9 | 1.55 | 0.979 | 80.9 | 36.9 |

| | b* | C* | Difference from JC2001 (on ab plane) | $(L^{*2} + c^{*2})^{0.5}$ | Difference from JC2001 (on Lab space) | Evaluation |
|---|---|---|---|---|---|---|
| Example 1 | −4.3 | 73.2 | −1.7 | 94.7 | 7.3 | A |
| Example 2 | −5.6 | 71.2 | −3.7 | 97.6 | 10.1 | A |
| Example 3 | −3.2 | 77.5 | 2.5 | 99.1 | 11.6 | A |
| Example 4 | −5.3 | 77.7 | 2.7 | 99.5 | 12.1 | A |
| Example 5 | −3.3 | 77.9 | 3.0 | 99.1 | 11.6 | A |
| Example 6 | −0.1 | 72.8 | −2.2 | 97.0 | 9.6 | A |
| Example 7 | −4.2 | 64.3 | −10.7 | 94.5 | 7.1 | B |
| Example 8 | −4.3 | 72.5 | −2.4 | 98.3 | 10.9 | A |
| Example 10 | −4.6 | 76.3 | 1.4 | 97.3 | 9.9 | A |
| Example 11 | −5.5 | 75.3 | 0.3 | 96.9 | 9.5 | A |

TABLE 2-continued

| | | | | | | |
|---|---|---|---|---|---|---|
| Example 12 | −5.4 | 78.4 | 3.4 | 99.6 | 12.2 | A |
| Comparative Example 1 | −3.6 | 52.5 | −22.5 | 55.7 | −31.8 | C |
| Comparative Example 2 | −2.4 | 47.3 | −27.7 | 51.3 | −36.2 | C |
| Comparative Example 3 | −1.8 | 28.0 | −47.0 | 29.4 | −58.0 | C |
| Comparative Example 4 | −7.6 | 49.0 | −26.0 | 59.0 | −28.4 | C |
| Comparative Example 5 | −2.0 | 37.0 | −38.0 | 88.9 | 1.5 | C |

Apparently from Table 2, the toners obtained in the present invention have higher lightness and saturation and have spectral reflection properties having a wider color range than those in the toners for comparison.

Liquid Developer

Example 9

160 parts of LINEALENE Dimer A-20 (made by Idemitsu Kosan Co. Ltd.) was mixed with 16 parts of a resin, and dispersed for 1 hour by an Attritor (made by Mitsui Mining Co., Ltd.). Further, a 20 parts LINEALENE Dimer A-20 solution of 3 parts of the compound (1) was added little by little to obtain a colored resin dispersion liquid. Further, 2 parts of zirconium naphthenate (nonvolatile content of 49% by mass, made by DIC Corporation) was added. Subsequently, the obtained solution was diluted 8 times with LINEALENE Dimer A-20 to obtain a liquid developer. The volume average particle size was 5.5 μm.

Examples 10 and 11

Toners (9) and (10) were obtained in the same manner as in Example 1 except that compounds (8) and (10) were used instead of the compound (1) in the method according to the production of the colorant particle dispersion liquid (1) in Example 1. The same evaluation as in Example 1 was performed on the obtained toners. The result of evaluation is shown in Table 2.

Example 12 binder resin (polyester resin): 100 parts by mass (Tg of 55° C., acid value of 20 mgKOH/g, hydroxyl value of 16 mgKOH/g, molecular weight: Mp of 4500, Mn of 2300, Mw of 38000)

compound (5): 6 parts by mass 1,4-di-t-butylaluminum salicylate compound: 0.5 parts by mass paraffin wax (the largest endothermic peak temperature of 78° C.): 5 parts by mass The formula was sufficiently mixed with a Henschel mixer (FM-75J, made by Mitsui Mining Co., Ltd.), and kneaded by a twin screw kneader (PCM-45, made by Ikegai Ironworks Corp.) set at a temperature of 130° C. at a feed amount of 60 kg/hr (the temperature of the kneaded product at discharge was approximately 150° C.). The obtained kneaded product was cooled, crushed by a hammer mill, and pulverized by a mechanical mill (T-250: made by FREUND-TURBO CORPORATION) at a feed amount of 20 kg/hr.

The obtained pulverized product of the toner was classified by a multi classifier using a Coanda effect to obtain a toner base particle (11).

The obtained toner base particle (11) was subjected to external addition in the same manner as in Example 1 to obtain a toner (11).

The toner (11) had a weight average particle size (D4) of 6.0 μm, in which the particle having a particle size of not more than 4.0 μm was 30.2% by number, and the particle having a particle size of not less than 10.1 μm was 0.6% by volume.

The same evaluation as in Example 1 was performed on the obtained toner (11). The result of evaluation is shown in Table 2.

INDUSTRIAL APPLICABILITY

The present invention can provide a magenta toner having spectral reflection properties having high lightness and saturation. The magenta toner can be used in an image forming apparatus using electrophotography.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-163862, filed Jul. 27, 2011, which is hereby incorporated by reference herein in its entirety.

The invention claimed is:

1. A magenta toner comprising magenta toner particles each comprising a binder resin and a colorant, wherein the colorant comprises a compound represented by a formula (1):

Formula (1)

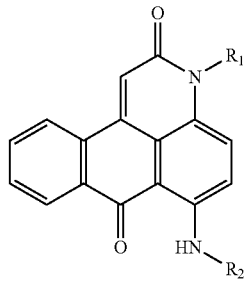

wherein $R_1$ and $R_2$ represent an alkyl group or an alkoxyalkyl group, and at least one of $R_1$ and $R_2$ has not less than 7 carbon atoms.

2. The magenta toner according to claim 1, wherein one of $R_1$ and $R_2$ in the formula (1) is a 2-ethylhexyl group.

3. The magenta toner according to claim 1, wherein one of $R_1$ and $R_2$ in the formula (1) is a 3-butoxypropyl group or a 3-(2-ethylhexyloxyl)propyl group.

4. The magenta toner according to claim 1, wherein the magenta toner particle contains wax.

5. The magenta toner according to claim 1, wherein the magenta toner particle is obtained by a suspension polymerization method.

6. The magenta toner according to claim 1, wherein the magenta toner particle is obtained by an emulsion agglutination method.

7. The magenta toner according to claim 1, wherein the magenta toner particle is obtained by a melt-kneading pulverization method.

8. A method for producing a magenta toner comprising the steps of:

mixing a compound represented by a formula (1) with an organic solvent to prepare a colorant dispersion;

mixing the colorant dispersion with a polymerizable monomer to prepare a polymerizable monomer composition;

dispersing the polymerizable monomer composition in a water-based medium and granulating the polymerizable monomer composition to produce droplets of the polymerizable monomer composition; and polymerizing the polymerizable monomer in the droplets to produce a magenta toner particle, wherein a toner to be obtained is a magenta toner comprising magenta toner particles each comprising a binder resin and a colorant, wherein the colorant comprises a compound represented by a formula (1):

Formula (1)

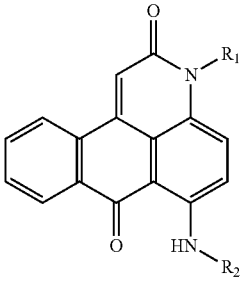

wherein $R_1$ and $R_2$ represent an alkyl group or an alkoxyalkyl group, and at least one of $R_1$ and $R_2$ has not less than 7 carbon atoms.

9. A method for producing a magenta toner comprising the steps of:

mixing a compound represented by a formula (1) with an organic solvent to prepare a colorant dispersion;

mixing the colorant dispersion and the binder resin with an organic solvent to prepare a solvent composition;

dispersing the solvent composition in a water-based medium and granulating a particle of the solvent composition; and removing the organic solvent from the particle to produce a magenta toner particle, wherein a toner to be obtained is a magenta toner comprising a magenta toner particle comprising a binder resin and a colorant, wherein the colorant comprises a compound represented by a formula (1):

Formula (1)

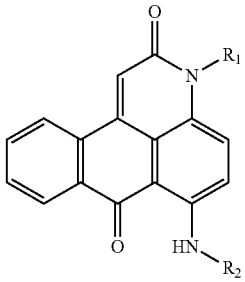

wherein $R_1$ and $R_2$ represent an alkyl group or an alkoxyalkyl group, and at least one of $R_1$ and $R_2$ has not less than 7 carbon atoms.

* * * * *